US010343266B2

(12) United States Patent
Zimmermann et al.

(10) Patent No.: US 10,343,266 B2
(45) Date of Patent: Jul. 9, 2019

(54) BIT HOLDER ASSEMBLY

(71) Applicant: Milwaukee Electric Tool Corporation, Brookfield, WI (US)

(72) Inventors: Michael J. Zimmermann, New Berlin, WI (US); Smith C. Theiler, Plymouth, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 229 days.

(21) Appl. No.: 15/374,253

(22) Filed: Dec. 9, 2016

(65) Prior Publication Data

US 2017/0165818 A1 Jun. 15, 2017

Related U.S. Application Data

(60) Provisional application No. 62/265,667, filed on Dec. 10, 2015.

(51) Int. Cl.

| | |
|---|---|
| ***B25B 21/00*** | (2006.01) |
| ***B25B 23/12*** | (2006.01) |
| ***B25B 23/00*** | (2006.01) |

(52) U.S. Cl.

CPC ..... *B25B 23/0035* (2013.01); *B25B 21/00* (2013.01); *B25B 23/12* (2013.01)

(58) Field of Classification Search

CPC ..... B25B 21/00; B25B 23/0035; B25B 23/12
See application file for complete search history.

(56) References Cited

U.S. PATENT DOCUMENTS

| | | | | |
|---|---|---|---|---|
| 3,056,441 | A * | 10/1962 | Helms | B25B 23/00 81/429 |
| 3,146,811 | A * | 9/1964 | Shryock | B25B 23/00 192/103 R |
| 4,753,142 | A * | 6/1988 | Hornung | B25B 15/001 81/429 |
| 5,464,229 | A | 11/1995 | Salpaka | |
| 5,682,800 | A * | 11/1997 | Jore | B25B 21/007 81/429 |
| 5,996,452 | A * | 12/1999 | Chiang | B25B 15/001 279/157 |
| 6,192,776 | B1 * | 2/2001 | Leitner | B23B 31/1071 81/429 |
| 6,199,872 | B1 | 3/2001 | Hasan | |
| 6,311,989 | B1 * | 11/2001 | Rosanwo | B25B 15/001 279/75 |

(Continued)

*Primary Examiner* — Joseph J Hail
*Assistant Examiner* — Arman Milanian
(74) *Attorney, Agent, or Firm* — Michael Best & Friedrich LLP

(57) ABSTRACT

A bit holder assembly includes a barrel having a shank receiving end, a bit receiving end, and an inner wall extending between the shank receiving end and the bit receiving end. The bit holder assembly also includes a shank sized and shaped to be received within the barrel. The shank is insertable into the barrel from the shank receiving end. The bit holder assembly further includes a shuttle having an annular recess. The shuttle is sized and shaped to be received within the barrel and is insertable into the barrel from the bit receiving end. The bit holder assembly also includes a retaining member sized and shaped to be received within the annular recess. The retaining member is configured to retain the shuttle within the barrel.

10 Claims, 10 Drawing Sheets

(56) References Cited

U.S. PATENT DOCUMENTS 6,325,393 B1 12/2001 Chen et al.
6,345,560 B1 * 2/2002 Strauch ..... B25B 15/001 81/477
6,457,916 B2 10/2002 Wienhold
6,561,523 B1 5/2003 Wienhold
6,637,755 B2 10/2003 Chen et al.
6,695,321 B2 * 2/2004 Bedi ..... B25B 15/001 279/22
6,840,143 B1 1/2005 Lin
6,860,489 B2 3/2005 Chen
6,929,266 B2 8/2005 Peters et al.
6,953,196 B1 10/2005 Huang
6,966,562 B1 11/2005 Wienhold
7,114,728 B2 10/2006 Chen
7,124,665 B1 10/2006 Chen
7,159,493 B1 1/2007 Huang
7,287,449 B2 10/2007 Abel et al.
7,306,396 B1 * 12/2007 Chen ..... B25B 13/5008 279/74
7,387,054 B2 * 6/2008 Rajotte ..... B25B 15/001 279/75
7,424,841 B2 9/2008 Liu
7,448,302 B2 11/2008 Huang
7,565,854 B2 * 7/2009 Chiang ..... B25B 15/001 279/75
7,581,470 B1 * 9/2009 Huang ..... B25B 23/0035 279/22
7,726,664 B2 6/2010 Peters
7,913,592 B2 3/2011 Hu
7,954,824 B2 6/2011 Hu
8,172,236 B2 * 5/2012 Shibata ..... B25B 15/001 279/128
8,240,233 B2 8/2012 Huang
8,262,097 B2 * 9/2012 Lai ..... B23B 31/107 279/155
8,267,408 B2 9/2012 Chen
8,308,168 B2 * 11/2012 Nash ..... B25B 23/0035 279/155
8,550,471 B2 10/2013 Huang
8,622,401 B2 1/2014 Puzio et al.
8,671,804 B2 3/2014 Galat
8,690,164 B2 4/2014 Meng
9,101,987 B2 * 8/2015 Cornwell ..... B23B 31/107
9,174,285 B2 * 11/2015 Chang ..... B25B 15/001
2003/0178794 A1 * 9/2003 Chen ..... B25B 15/001 279/22
2004/0164503 A1 * 8/2004 Fan-Chiang ..... B25B 15/001 279/75
2005/0045001 A1 * 3/2005 Huang ..... B25B 15/001 81/177.85
2006/0145431 A1 7/2006 Chang
2007/0108706 A1 * 5/2007 Cornwell ..... B25B 15/001 279/143
2007/0272061 A1 11/2007 Hsieh
2008/0072718 A1 * 3/2008 Liu ..... B25B 15/001 81/438
2008/0121075 A1 * 5/2008 Meng ..... B25B 15/001 81/177.85
2008/0190251 A1 * 8/2008 Huang ..... B25B 23/0035 81/438
2009/0008886 A1 * 1/2009 Shu ..... B23B 31/06 279/103
2009/0064827 A1 3/2009 Chen
2010/0031787 A1 * 2/2010 Hu ..... B25B 13/481 81/477
2011/0023666 A1 2/2011 Hsu
2011/0089218 A1 * 4/2011 Santamarina ..... B23B 51/08 227/139
2012/0126497 A1 5/2012 Lin
2012/0326399 A1 12/2012 Lin
2013/0001897 A1 * 1/2013 Chen ..... B25B 15/001 279/82
2013/0220086 A1 * 8/2013 Peters ..... B23B 31/10 81/451
2014/0060269 A1 * 3/2014 Lin ..... B25B 19/00 81/463
2014/0182422 A1 * 7/2014 Kurtz ..... B25B 23/12 81/177.1
2014/0311302 A1 * 10/2014 Taguchi ..... B25B 23/0035 81/437
2015/0202751 A1 * 7/2015 Chen ..... B25B 23/0035 279/9.1

* cited by examiner

BIT HOLDER ASSEMBLY

CROSS-REFERENCE TO RELATED APPLICATIONS

This application claims priority to U.S. Provisional Application No. 62/265,667, filed Dec. 10, 2015, the entire contents of which are incorporated by reference herein.

BACKGROUND

The present invention relates to tool bit holders. More specifically, the present invention relates to a method of assembling a quick release bit holder.

Bit holders are used to releasably clamp a tool bit, such as a screw driver bit, to a shank or a drive shaft. The shank can be driven by a power tool that generates rotary power to the shank to drive the tool bit. Alternatively, the shank can be manually driven by a user. Releasable tool bit holders enable different tool bits to be used with the same shank and power tool.

SUMMARY

In one embodiment, the invention provides a bit holder assembly including a barrel having a shank receiving end, a bit receiving end, and an inner wall extending between the shank receiving end and the bit receiving end. The bit holder assembly also includes a shank sized and shaped to be received within the barrel. The shank is insertable into the barrel from the shank receiving end. The bit holder assembly further includes a shuttle having an annular recess. The shuttle is sized and shaped to be received within the barrel and is insertable into the barrel from the bit receiving end. The bit holder assembly also includes a retaining member sized and shaped to be received within the annular recess. The retaining member is configured to retain the shuttle within the barrel.

In another embodiment, the invention provides a method of assembling a bit holder assembly. The bit holder assembly includes a barrel having a shank receiving end configured to receive a shank and a bit receiving end configured to receive a tool bit. The method includes inserting a shank into the barrel from the shank receiving end, inserting a biasing member into the barrel from the bit receiving end, and inserting a shuttle into the barrel from the bit receiving end. The shuttle is biased toward the bit receiving end by the biasing member. The method includes retaining the shuttle within the barrel by a retaining member. The retaining member engages the shuttle and limits movement of the shuttle relative to the barrel. The method further includes inserting a tool bit into the barrel from the bit receiving end of the barrel.

In yet another embodiment, the invention provides a bit holder assembly including a barrel having a first end, a second end, and an inner wall extending between the first end and the second end. The inner wall defines a first region disposed adjacent the first end and having a first diameter, a second region having a second diameter, and a third region disposed adjacent the second end and having a third diameter. The second region is disposed between the first and third regions. The second diameter is greater than the first diameter and the third diameter such that a first ridge is formed between the first region and the second region and a second ridge is formed between the second region and the third region. The bit holder assembly also includes a shank sized and shaped to be received within the barrel. The shank is insertable into the barrel from the second end. The bit holder assembly further includes a shuttle having an annular recess. The shuttle is sized and shaped to be received within the barrel and insertable into the barrel from the first end. The bit holder assembly also includes a retaining member sized and shaped to be received within the annular recess of the shuttle. The retaining member is at least partially compressible within the annular recess of the shuttle such that the shuttle and the retaining member are insertable into the barrel as a single unit. The retaining member is expandable once inserted into the barrel such that the retaining member is engagable with the ridge to retain the shuttle within the barrel.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
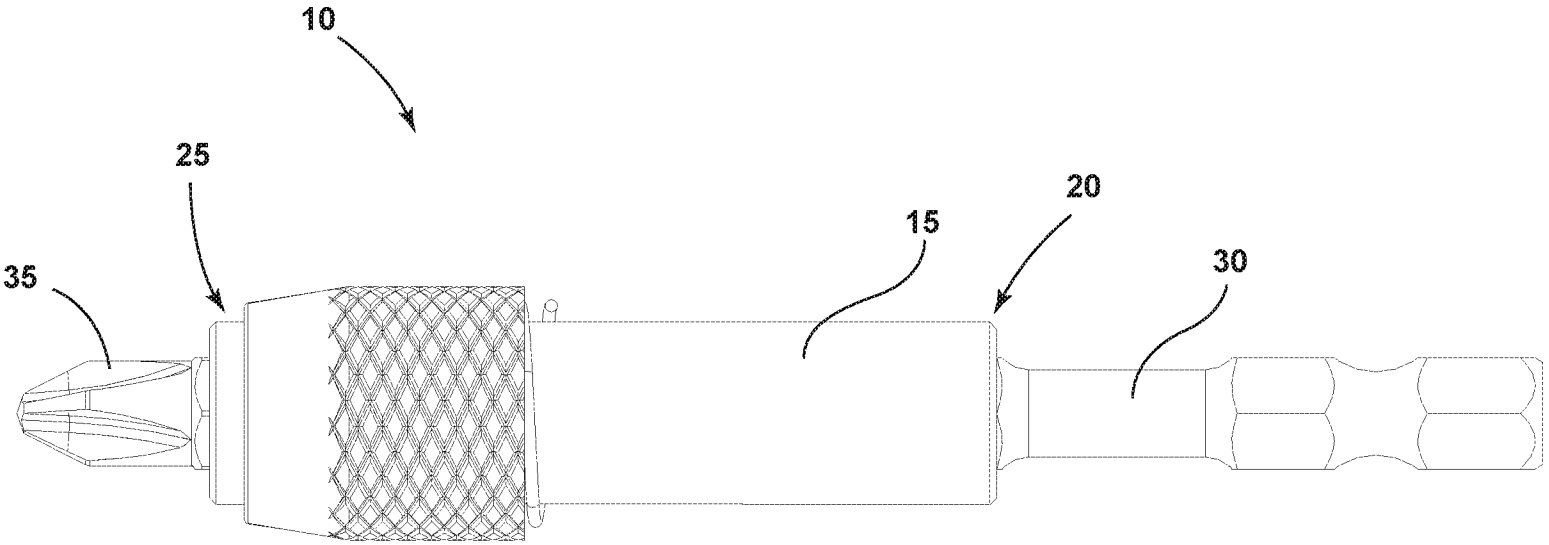
FIG. 1 is a side view of a bit holder assembly according to one embodiment of the invention.
Figure 2:
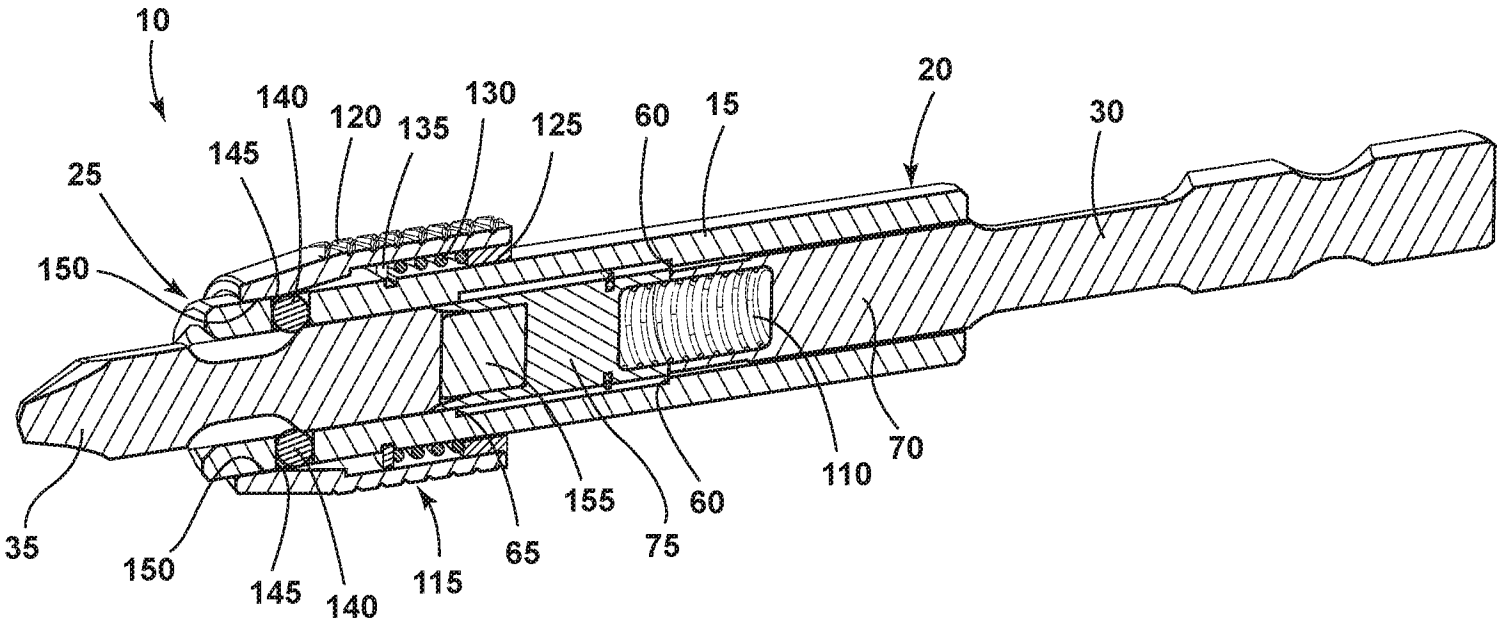
FIG. 2 is a cross-sectional view of the bit holder assembly of FIG. 1.

FIGS. 1-2 illustrate a bit holder assembly 10. The illustrated bit holder assembly 10 includes a barrel 15 having a shank receiving end 20 and a bit receiving end 25. The shank receiving end 20 is a first end of the barrel 15 and is configured to receive a shank 30 of the bit holder assembly 10. The bit receiving end 25 is a second end of the barrel 15 and is configured to receive a tool bit 35. For example, a tool bit 35 can include a screw driver bit, a hex bit, a torque bit, and the like. The shank 30 can be driven by a power tool (not shown), which generates rotary power to the shank 30, and thereby, to the tool bit 35. Alternatively, the shank 30 can be manually driven by a user.

Figure 3:
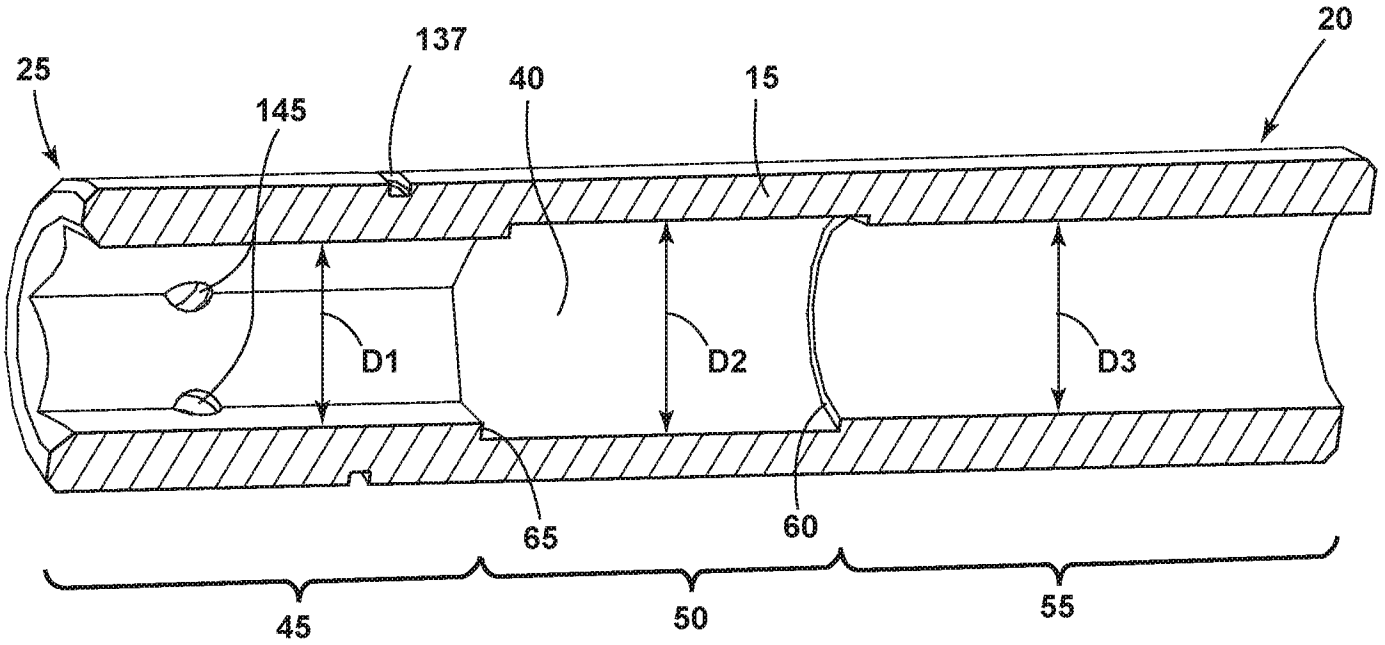
FIG. 3 is a cross-sectional view of a barrel of the bit holder assembly of FIG. 1.

As shown in FIG. 3, the barrel 15 is generally cylindrical in shape and includes an inner wall 40 defining a cavity for receiving the shank 30 and the tool bit 35. The inner wall 40 is divided into a first region 45 disposed adjacent the bit receiving end 25, a second region 50, and a third region 55 disposed adjacent the shank receiving end 20. The second region 50 is disposed between the first and third regions 45, 55. The first region 45 of the inner wall 40 is hexagonal and has an inner diameter D1. The second and third regions 50, 55 are cylindrical and have inner diameters D2 and D3, respectively. The inner diameter D2 of the second region 50 is greater than the inner diameter D3 of the third region 55. Therefore, a ridge 60 is formed between the second and third regions, 50, 55. The inner diameter D1 of the first region 45 is slightly smaller than the inner diameter D2 of the second region 50. In addition, the hexagonal edges of the inner wall 40 of the first section 45 extend radially beyond the inner wall 40 of the second region 50. Thus, the edges of the hexagonal wall form a ridge 65 between the first and second regions 45, 50.

Referring back to FIG. 2, the tool bit 35 is received within the first region 45 at the bit receiving end 25 of the barrel 15. The shank 30 includes a stem 70 that extends into the third region 55 of the barrel 15, while a remainder of the shank 30 remains external to the barrel 15. The bit holder assembly 10 also includes a shuttle 75 positioned in the second region 50 of the barrel 15, between the shank 30 and the tool bit 35.

Figure 4:
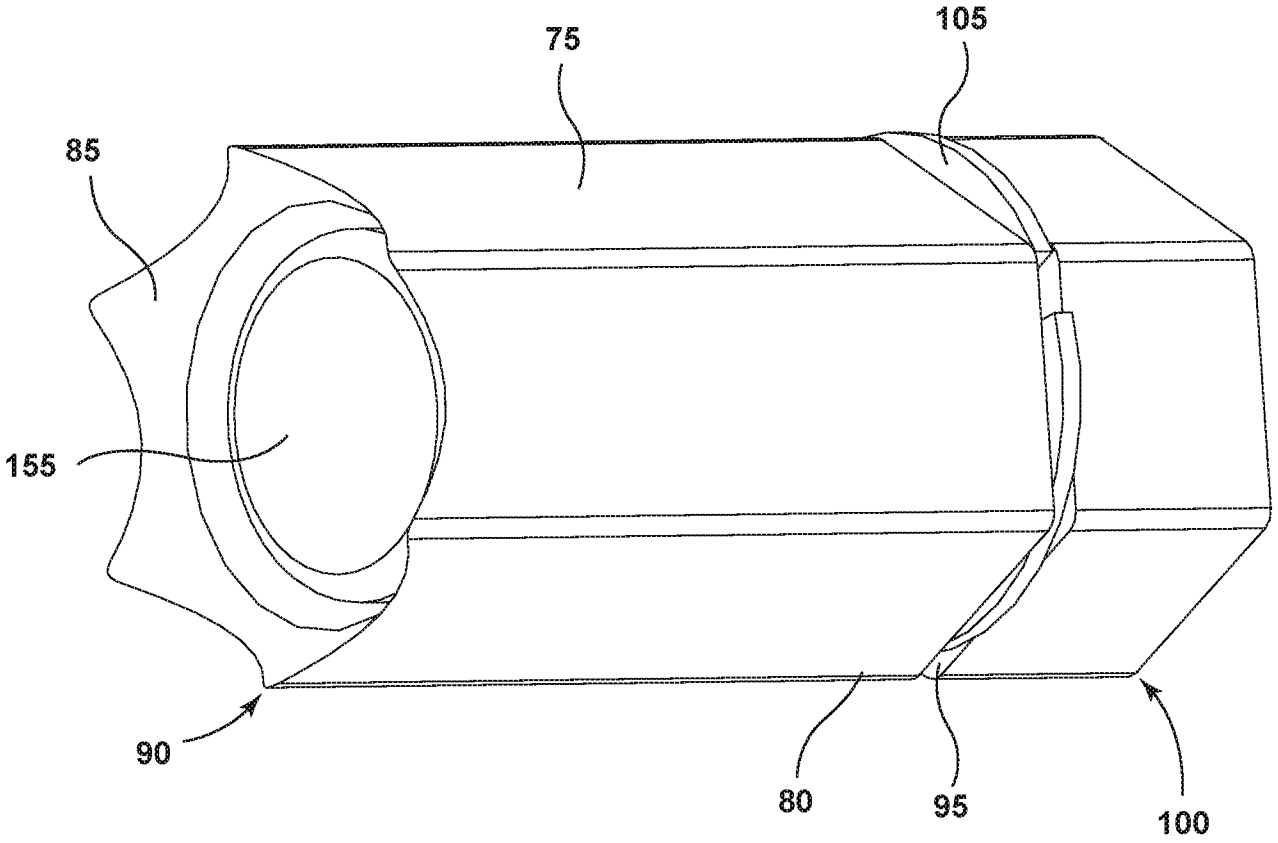
FIG. 4 is a perspective view of a shuttle, a magnet, and c-ring of the bit holder assembly of FIG. 1.
Figure 5:
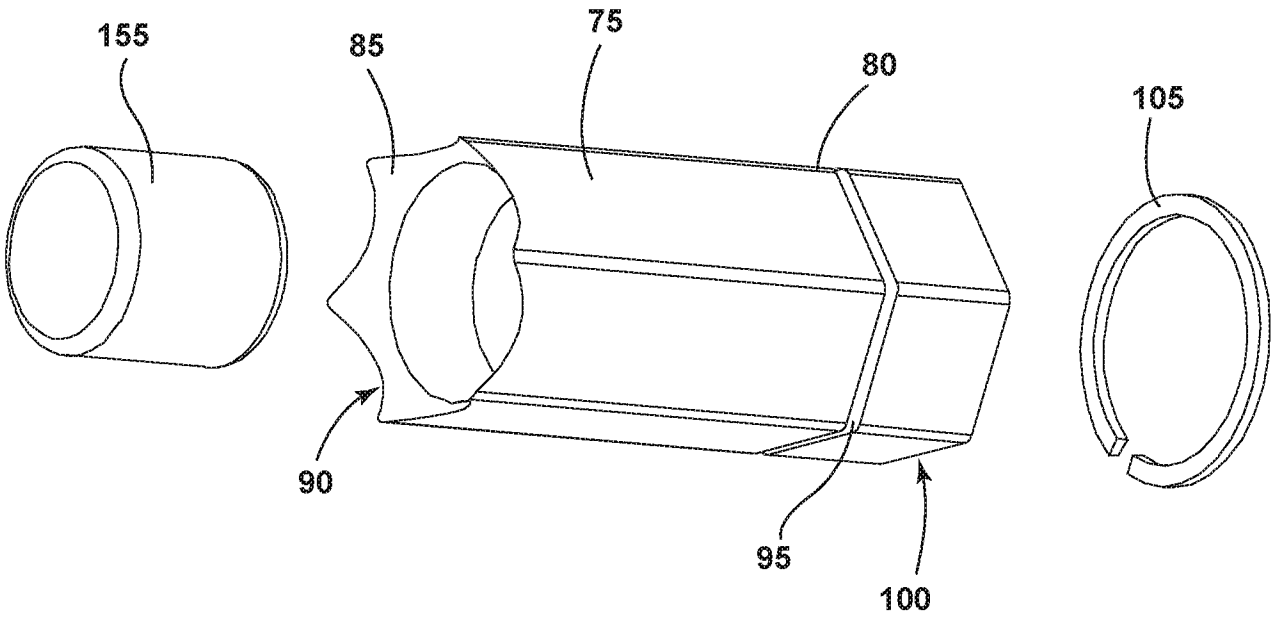
FIG. 5 is an exploded view of the shuttle, the magnet, and the c-ring of FIG. 4.

As shown in FIGS. 4 and 5, the illustrated shuttle 75 is generally cylindrical in shape with a hexagonal outer surface 80. The shuttle 75 includes a receptacle 85 on a first end 90 that is sized and shaped to receive part of the tool bit 35. An annular recess 95 is disposed near a second end 100 of the shuttle 75. The annular recess 95 is sized and shaped to receive a retaining member 105. In the illustrated embodiment, the retaining member 105 is a c-ring. However, in other embodiments, different retaining members may also or alternatively be used. Referring to the illustrated embodiment, the annular recess 95 extends deep enough into the shuttle 75 to receive the c-ring 105 such that when the c-ring 105 is compressed, the c-ring 105 does not extend beyond the outer surface 80 of the shuttle 75. In other embodiments, the c-ring 105 is not compressed fully until it does not extend beyond the outer surface 80 of the shuttle 75. Instead, the c-ring 105 may be partially compressed such that the c-ring 105 and the shuttle 75 can be inserted into the barrel 15. Accordingly, the shuttle 75 is solid for at least a portion of its length to enable the annular recess 95 to be deep enough to accommodate the c-ring 105. Alternatively, in another embodiment, the shuttle 75 has a relatively thick outer wall such that the annular recess 95 can extend deep enough into the wall to accommodate the c-ring 105.

Figure 6:
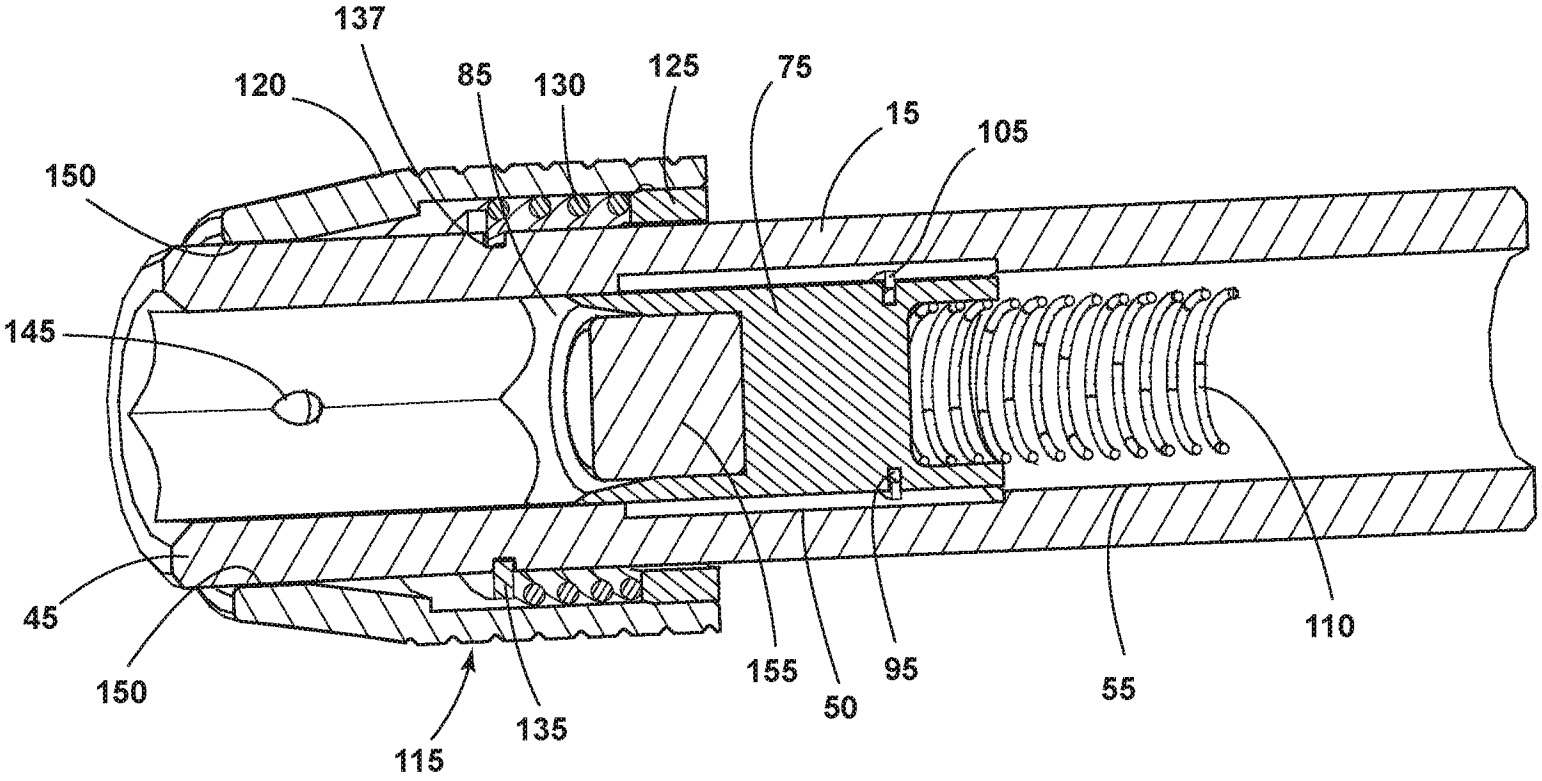
FIG. 6 is a cross-sectional view of the shuttle, the magnet, and the c-ring of FIG. 4 assembled in the barrel of FIG. 3.

As shown in FIG. 6, the shuttle 75 is capable of moving within the first and second regions 45, 50 of the barrel 15. The shuttle 75 is biased toward the bit receiving end 25 of the barrel 15 by a biasing member 110 disposed between the shank 30 (FIG. 2) and the shuttle 75. In the illustrated embodiment, the biasing member 110 is a coil spring; however, other types of biasing members may also or alternatively be used. The biasing member 110 biases the shuttle 75 towards the bit receiving end 25, and in turn, the shuttle 75 pushes the tool bit 35 axially outward towards the bit receiving end 25 of the barrel 15. The c-ring 105 inhibits the shuttle 75 from moving entirely out of the second region 50 of the barrel 15 through the first region 45. When the c-ring 105 is in a relaxed (i.e., non-compressed) state, the c-ring 105 extends radially beyond the out surface 80 of the shuttle 75. In this state, as the biasing member 110 pushes the shuttle 75 towards the bit receiving end 25 of the barrel 15, the c-ring 105 engages the ridge 65 formed by the edges of the hexagonal wall of the first region 45.

In the illustrated embodiment, the shuttle 75 is also inhibited from moving out of the barrel 15 through the third region 55. More particularly, the shuttle 75 has an outer shape and size (e.g., diameter) that is larger than the diameter D3 of the third region 55. As such, the shuttle 75 does not fit in or through the third region 55. Instead, when an end of the shuttle 75 reaches the third region 55, the end of the shuttle 75 contacts the ridge 60, inhibiting further movement of the shuttle 75.

Figure 7:
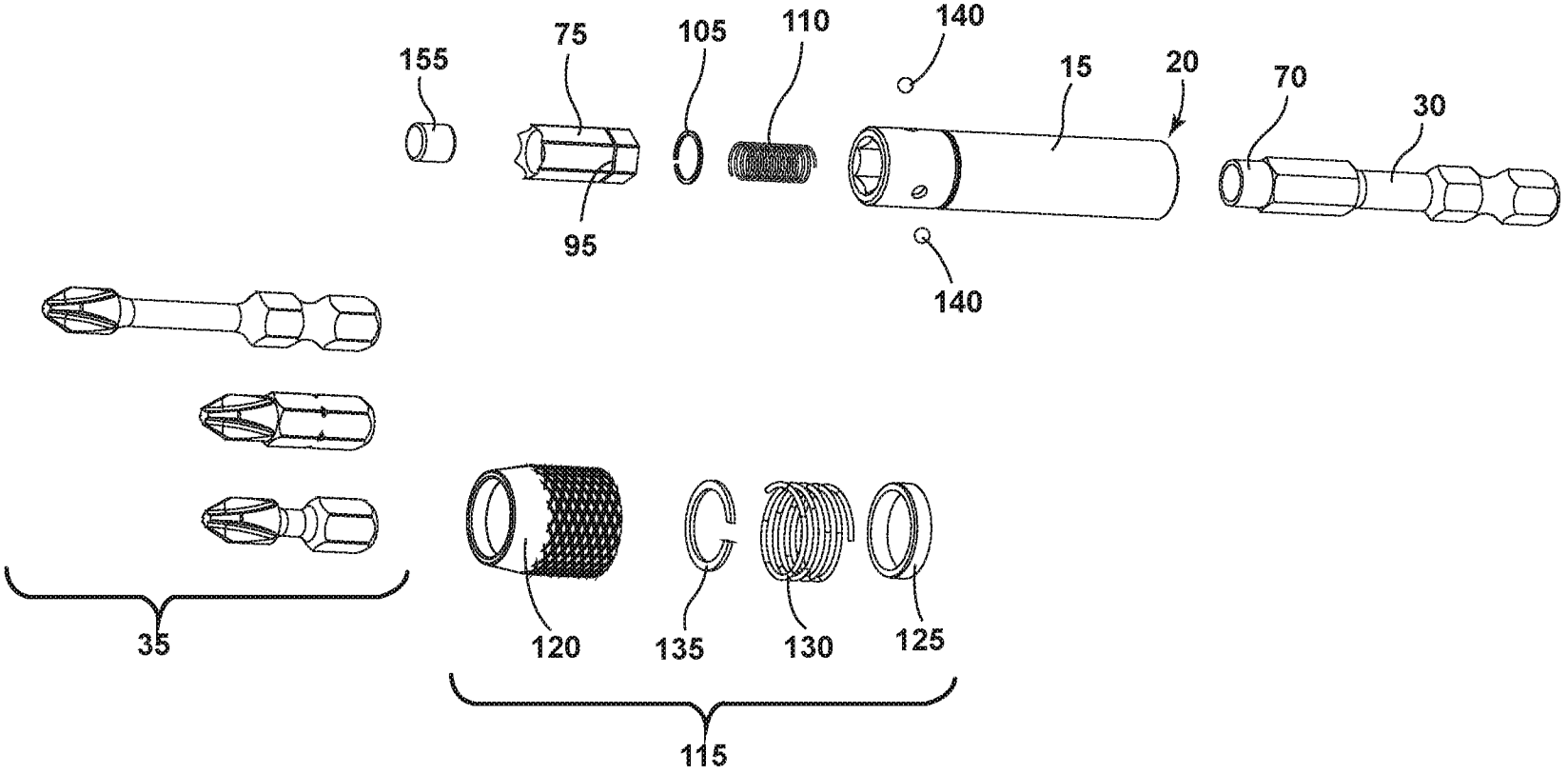
FIG. 7 is an exploded view of the bit holder assembly of FIG. 1.

With reference to FIGS. 2 and 7, the bit holder assembly 10 includes a retaining assembly 115 that selectively retains the tool bit 35 within the barrel 15 so that the tool bit 35 is not pushed entirely out of the barrel 15 by the shuttle 75. In the illustrated embodiment, the retaining assembly 115 includes a collar 120, a collar ring 125, a biasing member 130, a retaining ring 135, and one or more retaining balls 140. The collar ring 125, the biasing member 130, and the retaining ring 135 are positioned concentrically around the barrel 15. The collar 120 concentrically surrounds the collar ring 125, the biasing member 130, and the retaining ring 135. The collar 120 is movable in an axial direction relative to the barrel 15. The collar ring 125 is fixed to the collar 120 and is movable relative to the barrel 15 with the movement of the collar 120. The retaining ring 135 is received within an annular groove 137 (FIGS. 3 and 6) of the barrel 15 and is fixed relative to the barrel 15. The biasing member 130 is disposed between the collar ring 125 and the retaining ring 135. The biasing member 130 biases the collar ring 125, and thus, the collar 120, away from the retaining ring 135. The retaining balls 140 extend through holes 145 (FIG. 3) in the barrel 15 and are engagable with the tool bit 35 to maintain the tool bit 35 within the barrel 15.

The retaining assembly 115 is adjustable between a first or locked position, which inhibits the tool bit 35 from being removed from the bit holder assembly 10, and a second or unlocked position, which enables the tool bit 35 to be removed from the bit holder assembly 10. As a default, the retaining assembly 115 is biased toward the locked position. In the locked position, the collar 120 is biased toward the shaft receiving end 20 of the barrel 15 by the biasing member 130. Specifically, the biasing member 130 pushes against the retaining ring 135 to drive the collar ring 125, and thus the collar 120, toward the bit receiving end 20 of the barrel 15. When in the locked position, a cam surface 150 on the inside of the collar 120 biases the retaining balls 140 radially inward to engage with the tool bit 35 and retain the tool bit 35 in the barrel 15.

To release the tool bit 35, the retaining assembly 115 is moved (e.g., slid linearly) from the locked position to the unlocked position. A user may apply a counter force to the collar 120 to move the collar 120 toward the bit receiving end 25. When a counter force is applied to the collar 120, the collar ring 125 moves with the collar 120 and compresses the biasing member 130. When the collar 120 is displaced, the cam surface 150 no longer biases the retaining balls 140 into engagement with the tool bit 35. Thus, the retaining balls 140 can move radially outward to release the tool bit 35 from the barrel 15.

To help inhibit the tool bit 35 from falling out of the bit holder assembly 10 when the retaining assembly 115 is in the unlocked position, the illustrated bit holder assembly 10 also includes a magnet 155. The magnet 155 is positioned at least partially within the shuttle 75 to hold the tool bit 35 until the user manually removes the tool bit 35. The illustrated magnet 155 is positioned on the first end 90 of the shuttle 75 proximate the receptacle 85 that receives the tool bit 35.

A bit holder is conventionally assembled by inserting the shuttle into the barrel through the same end of the barrel as the shank. Because the shuttle is generally larger than the shank, however, the barrel must be machined with a large enough opening to receive the shuttle. To inhibit the shank (and, thereby, the shuttle) from falling out of the barrel, a large protrusion is sometimes forged onto an end of the shank to help retain the shank in the barrel. This process requires additional time and expense. In contrast, the illustrated bit holder assembly 10 is assembled by inserting the shuttle 75 into the barrel 15 through the bit receiving end 25 (i.e., where the tool bits 35 are also inserted), rather than through the shank receiving end 20.

Referring to FIG. 7, the bit holder assembly 10 is assembled by inserting the shank 30 into the barrel 15 from the shank receiving end 20 of the barrel 15. Because the shuttle 75 is not inserted into the barrel 15 from the shank receiving end 20, the third region 55 of the barrel 15 is machined out only to the extent necessary to receive shank 30. Accordingly, the shank 30 is retained within the barrel 15 without forging a large protrusion into the end of the shank 30. The remaining elements of the tool bit 35 holder 10 may be inserted into or attached to the barrel 15 from the shank receiving end 20 of the barrel 15.

For example, the biasing member 110 is inserted into the barrel 15 from the bit receiving end 25. Then, the shuttle 75, the c-ring 105, and the magnet 155 (if a magnet 155 is included) are inserted into the barrel 15. Prior to inserting the shuttle 75 into the barrel 15, the c-ring 105 is positioned within the annular recess 95. The c-ring 105 is compressed within the annular recess 95 such that the c-ring 105 does not extend beyond the outer surface 80 of shuttle 75. As the shuttle 75 is pushed through the first region 45, the c-ring 105 remains compressed, and the hexagonal outer surface 80 of the shuttle 75 is generally flush with the hexagonal inner wall 40 of the first region 45 of the barrel 15. Specifically, the c-ring 105 is held in a compressed position by the inner wall 40 of the barrel 15. When the shuttle 75 and the c-ring 105 move beyond the first region 45 and into the second region 50, the c-ring 105 is no longer compressed by the inner wall 40 of the barrel 15. Therefore, the c-ring 105 relaxes and expands to a greater diameter than in the compressed state. For example, the c-ring 105 may extend beyond the outer surface 80 of the shuttle 75. Once the c-ring 105 relaxes, the c-ring 105 retains the shuttle 75 inside the cavity of the barrel 15. Specifically, the ridge 65 between the first and second regions 45, 50 and the ridge 60 between the second and third regions 50, 55 block the c-ring 105 from moving beyond the second region 50 in either direction.

Next, the retaining assembly 115 is assembled around the outside of the barrel 15. Specifically, the retaining balls 140 are positioned in the holes in the barrel 15. The collar ring 125, the biasing member 130, the retaining ring 135, and the collar 120 are slid onto the barrel 15. It should be apparent that the bit holder assembly 10 may be assembled in different orders. For example, in some embodiments, the retaining assembly 115 may be assembled on the barrel 15 before the shuttle 75, the c-ring 105, and the magnet 155 are inserted into the barrel 15.

Figure 8:
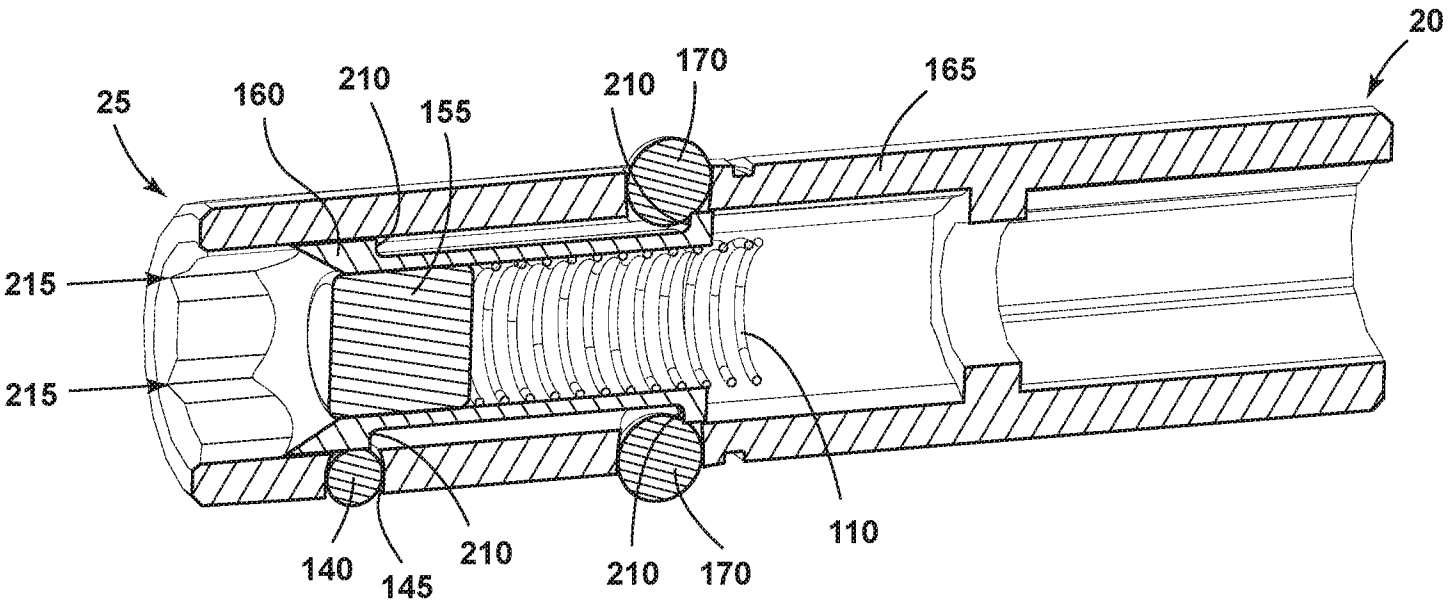
FIG. 8 is a cross-sectional view of part of a bit holder assembly according to another embodiment of the invention.
Figure 9:
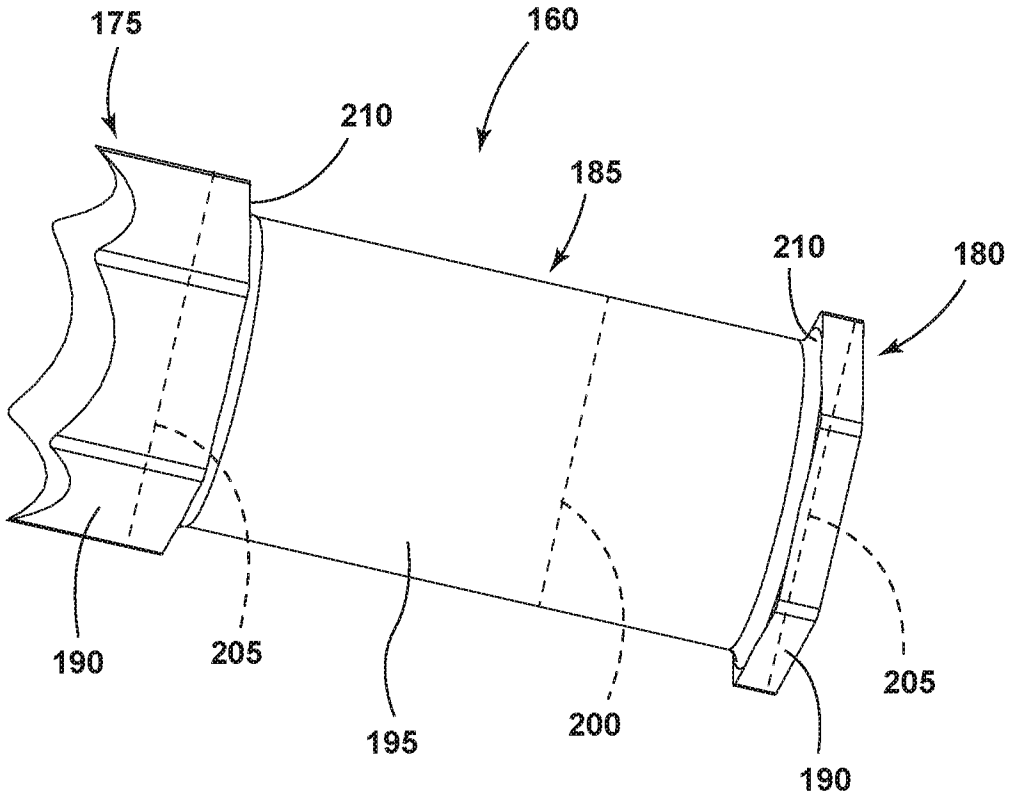
FIG. 9 is a perspective view of a shuttle of the bit holder assembly of FIG. 8.
Figure 10:
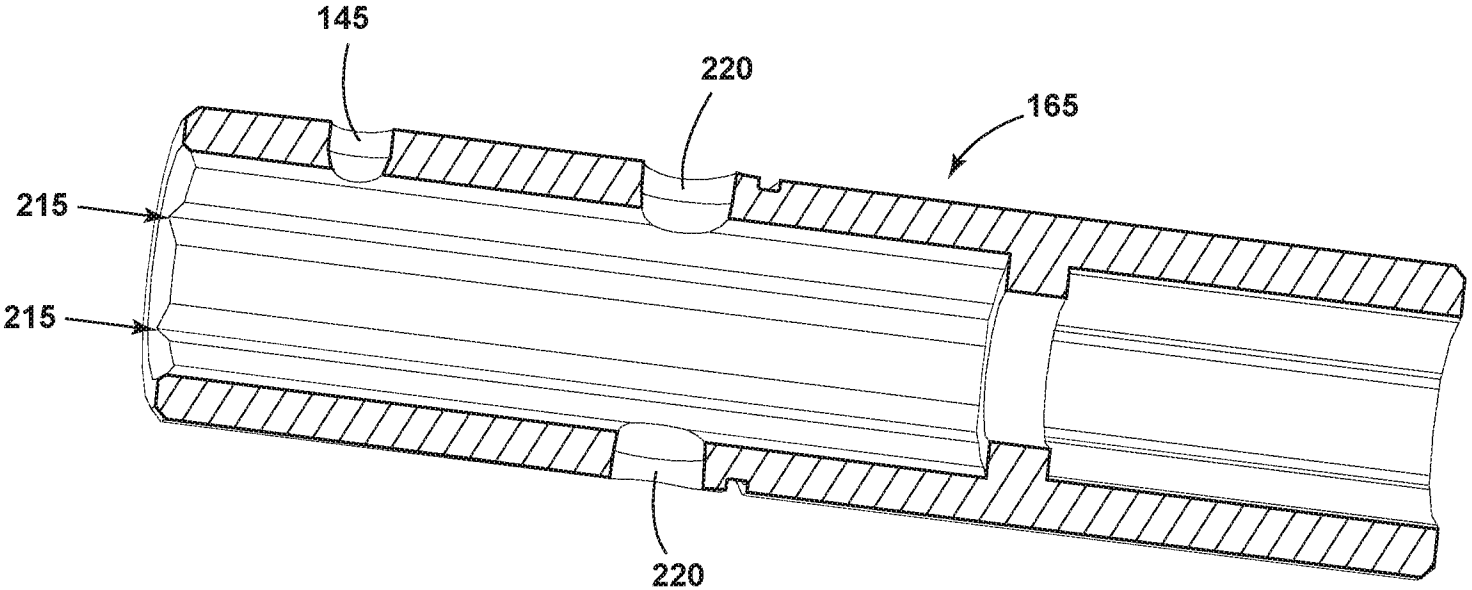
FIG. 10 is perspective view of a barrel of the bit holder assembly of FIG. 8.

FIGS. 8-10 illustrate alternative versions of a shuttle 160 and a barrel 165 for a bit holder assembly. In the illustrated embodiment, the retaining member that retains the shuttle 160 within the barrel 165 includes one or more retaining balls 170, rather than the c-ring 105. Specifically, the shuttle 160 includes a first end 175, a second end 180, and a central recessed portion 185 (e.g., an annular recess) disposed between the first and second ends 175, 180. A receptacle for receiving a tool bit is positioned on the first end 175 of the shuttle 160. The recessed portion 185 is elongated and extends axially along the shuttle 160 between the first end 175 and the second end 180. The first end 175 and the second end 180 have hexagonal outer surfaces 190, while the recessed portion 185 has a cylindrical outer surface 195. The recessed portion 185 has a diameter 200 that is less than diameters 205 of the first end 175 and the second end 180. The larger diameters 205 of the first end 175 and the second end 180 of the shuttle 160 protrude beyond the recessed portion 185, forming ridges 210 on the first and second ends 175, 180. The illustrated shuttle 160 is movable within the barrel 165 and is retained within the barrel 165 by the retaining balls 170.

As shown in FIGS. 8 and 10, the barrel 165 is similar to the barrel 15 discussed above. The illustrated barrel 165 is generally cylindrical in shape and includes an inner wall 40 defining a cavity. The inner wall 40 includes channels 215 that extend along the length of the barrel 165. The channels 215 are configured to receive the corners formed by the hexagonal outer surfaces 190 of the first and second ends 180 of the shuttle 160. The channels 215 guide the shuttle 160 as the shuttle 160 moves back and forth along the length of the barrel 165. The barrel 165 further includes through holes 220 that extend through the inner wall 40 of the barrel 165. The through holes 220 receive the retaining balls 170 that protrude through the inner wall 40 of the barrel 165 into the cavity. The retaining balls 170 engage the shuttle 160 along the recessed portion 185. As the shuttle 160 moves within the barrel 165, the retaining balls 170 roll along the outer surface 195 of the recessed portion 185. The retaining balls 170 retain the shuttle 160 within the barrel 165 by engaging the ridges 210 on the shuttle 160, formed by the larger diameter 205 of the first and second ends 175, 180. The ridges 210 and the retaining balls 170 inhibit the shuttle 160 from moving beyond a certain distance within the barrel 165.

The assembly of the shuttle 160 and the barrel 165 is similar to the assembly of the shuttle 75 and the barrel 15 described above. The shank 30 is inserted into the shank receiving end 20 of the barrel 165, while other parts of the bit holder assembly are inserted through the bit receiving end 25 of the barrel 165. In the illustrated embodiment, the shuttle 160 is inserted into the barrel 165 from the bit receiving 25 end, and the retaining balls 170 are inserted from the side of the barrel 165 into the through holes 220 to retain the shuttle 160 within the barrel 165. When the collar 120 is positioned concentrically around barrel 165, the retaining balls 170 are squeezed between the collar 120 and the shuttle 160.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A bit holder assembly comprising:

a barrel including a shank receiving end, a bit receiving end, and an inner wall extending between the shank receiving end and the bit receiving end;

a shank sized and shaped to be received within the barrel, the shank insertable into the barrel from the shank receiving end;

a shuttle including an annular recess, the shuttle sized and shaped to be received within the barrel and insertable into the barrel from the bit receiving end; and a retaining member sized and shaped to be received within the annular recess, the retaining member configured to retain the shuttle within the barrel;

wherein the retaining member includes a c-ring, and wherein the c-ring is at least partially compressible within the annular recess of the shuttle such that the shuttle and the c-ring are insertable into the barrel as a single unit; and wherein the inner wall of the barrel defines a first region disposed adjacent the bit receiving end, a second region, and a third region disposed adjacent the shank receiving end, wherein the second region is disposed between the first region and the third region, and wherein the first region has a first diameter, the second region has a second diameter that is larger than the first diameter, and the third region has a third diameter that is smaller than the second diameter.

2. The bit holder assembly of claim 1, wherein the c-ring is expandable within the second region of the barrel.

3. The bit holder assembly of claim 2, wherein the c-ring engages a ridge formed between the first region and the second region to retain the shuttle within the barrel.

4. A method of assembling a bit holder assembly, the bit holder assembly including a barrel having a shank receiving end configured to receive a shank and a bit receiving end configured to receive a tool bit, the method comprising:

inserting a shank into the barrel from the shank receiving end;

inserting a biasing member into the barrel from the bit receiving end;

inserting a shuttle into the barrel from the bit receiving end, the shuttle being biased toward the bit receiving end by the biasing member;

retaining the shuttle within the barrel by a retaining member, the retaining member engaging the shuttle and limiting movement of the shuttle relative to the barrel; and inserting a tool bit into the barrel from the bit receiving end of the barrel;

wherein retaining the shuttle within the barrel includes inserting a c-ring into an annular recess in the shuttle and at least partially compressing the c-ring unit so that the shuttle and the C-ring are inserted into the barrel as a single unit; and further comprising selectively locking the tool bit within the barrel using a retaining assembly, the retaining assembly including a collar that is movable in an axial direction relative to the barrel between the shank receiving end and the bit receiving end, and wherein selectively locking the tool bit within the barrel includes biasing the collar towards a lock position in which the collar is biased towards the shank receiving end of the barrel.

5. The method of claim 4, wherein the shank is inserted into the barrel before the shuttle is inserted into the barrel.

6. The method of claim 4, wherein retaining the shuttle within the barrel further includes allowing the c-ring to expand after the shuttle and the c-ring are inserted into the barrel.

7. The method of claim 4, further including retaining the tool bit within the barrel by a magnet disposed within the shuttle.

8. A bit holder assembly comprising:

a barrel including a first end, a second end, and an inner wall extending between the first end and the second end, the inner wall defining a first region disposed adjacent the first end and having a first diameter, a second region having a second diameter, and a third region disposed adjacent the second end and having a third diameter, the second region being disposed between the first and third regions, the second diameter being greater than the first diameter and the third diameter such that a first ridge is formed between the first region and the second region and a second ridge is formed between the second region and the third region;

a shank sized and shaped to be received within the barrel, the shank insertable into the barrel from the second end;

a shuttle including an annular recess, the shuttle sized and shaped to be received within the barrel and insertable into the barrel from the first end; and a retaining member sized and shaped to be received within the annular recess of the shuttle, the retaining member at least partially compressible within the annular recess of the shuttle such that the shuttle and the retaining member are insertable into the barrel as a single unit, the retaining member expandable once inserted into the barrel such that the retaining member is engagable with the ridge to retain the shuttle within the barrel.

9. The bit holder assembly of claim 8, wherein the shuttle includes a receptacle configured to receive a bit, and further comprising a biasing member that biases the shuttle and the bit toward the first end.

10. The bit holder assembly of claim 8, further comprising a retaining assembly configured to retain the bit at least partially within the first end of barrel, the retaining assembly including a collar extending concentrically around the barrel and slidable in an axial direction along the barrel, a biasing member biasing the collar toward the first end of the barrel, and a retaining ball engagable with a bit to retain the bit within the barrel, the retaining ball biased radially inward by the collar when the collar is moved to the first end of the barrel.

* * * * *